US005404601A

United States Patent [19]

O'Neill et al.

[11] Patent Number: 5,404,601

[45] Date of Patent: Apr. 11, 1995

[54] DUST RUFFLE CLAMP AND METHOD FOR ATTACHMENT TO BOX SPRING

[76] Inventors: Sallie A. O'Neill; Richard J. Schnoor, both of 17575 Bridle Ct., Jupiter, Fla. 33478

[21] Appl. No.: 272,759

[22] Filed: Jul. 11, 1994

[51] Int. Cl.[6] ..... A47C 21/02

[52] U.S. Cl. ..... 5/493; 5/498; 5/460; 160/491; 24/72.5; 24/456

[58] Field of Search ..... 5/493, 498, 460; 24/72.5, 456, 487, 545, 555, 562; 160/368.1, 393, 391

[56] References Cited

U.S. PATENT DOCUMENTS

| | | | |
|---|---|---|---|
| 719,477 | 10/1902 | Littell | 5/493 X |
| 2,149,970 | 3/1939 | Liebmann | 24/72.5 |
| 2,195,967 | 4/1940 | Liebmann | 24/72.5 |
| 3,959,854 | 6/1976 | Lewis | 5/493 X |
| 4,186,452 | 2/1980 | Underwood | 5/493 X |
| 4,708,183 | 11/1987 | Figueroa | 5/493 X |
| 5,105,492 | 4/1992 | Karpinski | 5/493 |

*Primary Examiner*—Michael F. Trettel
*Attorney, Agent, or Firm*—Thomas E. Coverstone

[57] ABSTRACT

A clamp for fastening a dust ruffle to a box spring of a bed where the box spring does not need modification for the fastening. The dust ruffle is fastened to a plurality of the clamps and is easily assembled and disassembled from the clamps for removal, cleaning, and changing of the dust ruffle.

9 Claims, 3 Drawing Sheets

DUST RUFFLE CLAMP AND METHOD FOR ATTACHMENT TO BOX SPRING

TECHNICAL FIELD

This invention relates to the attachment of a dust ruffle to a box spring of a bed.

BACKGROUND ART

Dust ruffles are made of a decorative fabric and are positioned between a box spring and a mattress of a bed, wherein the fabric of the dust ruffle extends to the length of the floor preventing the collection of dust and dirt underneath the bed. As shown in FIG. 1, the typical dust ruffle provides an aesthetic effect of the overall appearance of the bed. The typical dust ruffle extends beyond the length of the box spring to the floor on three of the four sides of the box spring. The weight of the mattress, however, does not provide enough compressive force between the box spring and the mattress to keep the dust ruffle in place as the bed is used. When the sheets are removed for cleaning and the mattress rotated for even wear of the mattress, the dust ruffle is difficult to keep in position on the box spring.

U.S. Pat. No. 5,086,531 discloses a dust ruffle with a separable fastener system, which maintains the dust ruffle in position on the box spring, however, each fastening means of the dust ruffle to the box spring disclosed requires modification to the box spring.

The prior art dust ruffle fastening means is achieved by securing a hook and loop fastener to the top horizontal fabric surface of the box spring. Over a extended period of use of removing and reapplying the dust ruffle to the box spring, the prior art fastening means would apply tensile stress to the top portion of the box spring fabric, which is not designed to have tensile stresses applied in this area. Continued use of this prior art fastener would cause distress to the material of the box spring where the hook and loop fasteners are attached, causing the fabric of the box spring to eventually tear or rip. The ripped box spring fabric in the area where the fastener is attached would not allow the user to continue to use the dust ruffle fasteners and would eventually require the user to purchase a new box spring before the utility of the box spring has expired.

U.S. Pat. No. 5,205,003 discloses the same type of fastening means, however, the hook and loop fasteners are attached to the vertical side of the box spring. This disclosure would cause the same type of problems of the above patent after repeated fastening and unfastening of the dust ruffle.

What is needed is a dust ruffle that can be easily applied to the box spring without having detrimental effects to the box spring itself.

DISCLOSURE OF THE INVENTION

The object of the present invention is to provide a dust ruffle clamp to be applied to the frame of a box spring, the clamp having means of fastening the dust ruffle to the clamp.

According to the present invention a clamp has a first end and a second end defining an inside clamping area that is to be clamped onto the top frame of a box spring. Tangentially extending from the clamp is an extension that is adjacent to a vertical side of the box spring after the clamp is applied to the frame. The clamp is preferably made from a resilient material so that the clamp can be easily applied by the user to the box spring by use of a lip and groove. An object, like a putty knife or screwdriver, is applied into the groove against the lip to separate the first end and the second end allowing the clamp to be positioned onto the box spring frame. The object is then removed and the clamp resumes its original shape, clamping to the box spring frame.

The extension has fastening means, such as a hook and loop fastener, for attaching a dust ruffle to the clamp. The clamp allows the dust ruffle to be attached to the box spring without having a detrimental affect to the box spring itself. The fastening means conveniently allows for the attachment and detachment of the dust ruffle to the clamp.

The foregoing and other features and advantages of the present invention will become more apparent from the following description and accompanying drawings.

BEST MODE FOR CARRYING OUT THE INVENTION

Figure 1:
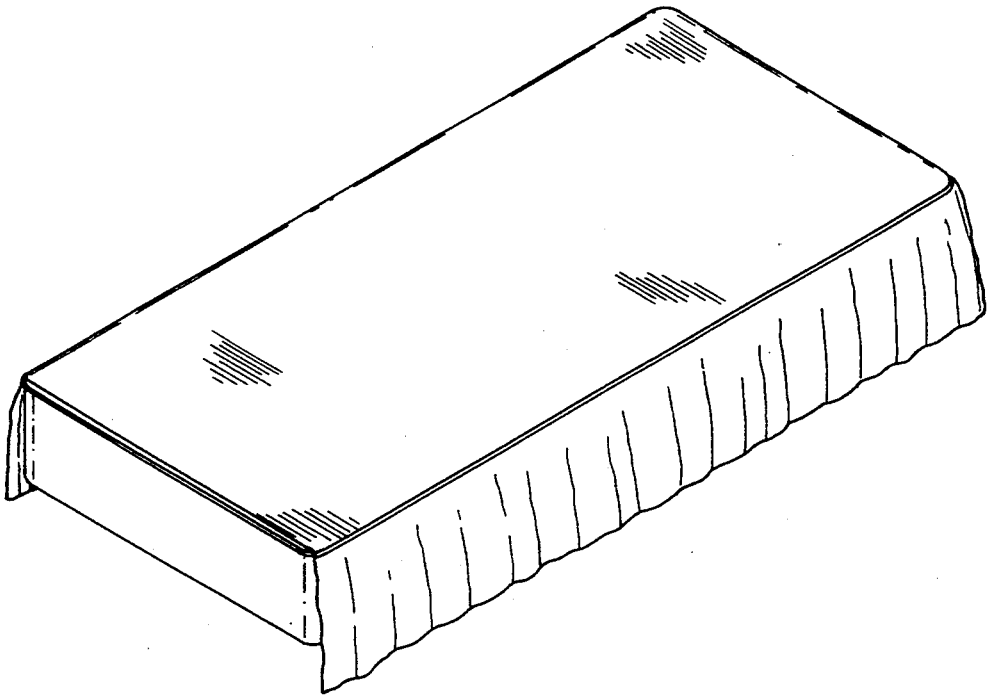
FIG. 1 is a perspective view of the dust ruffle attached to a box spring.
Figure 2:
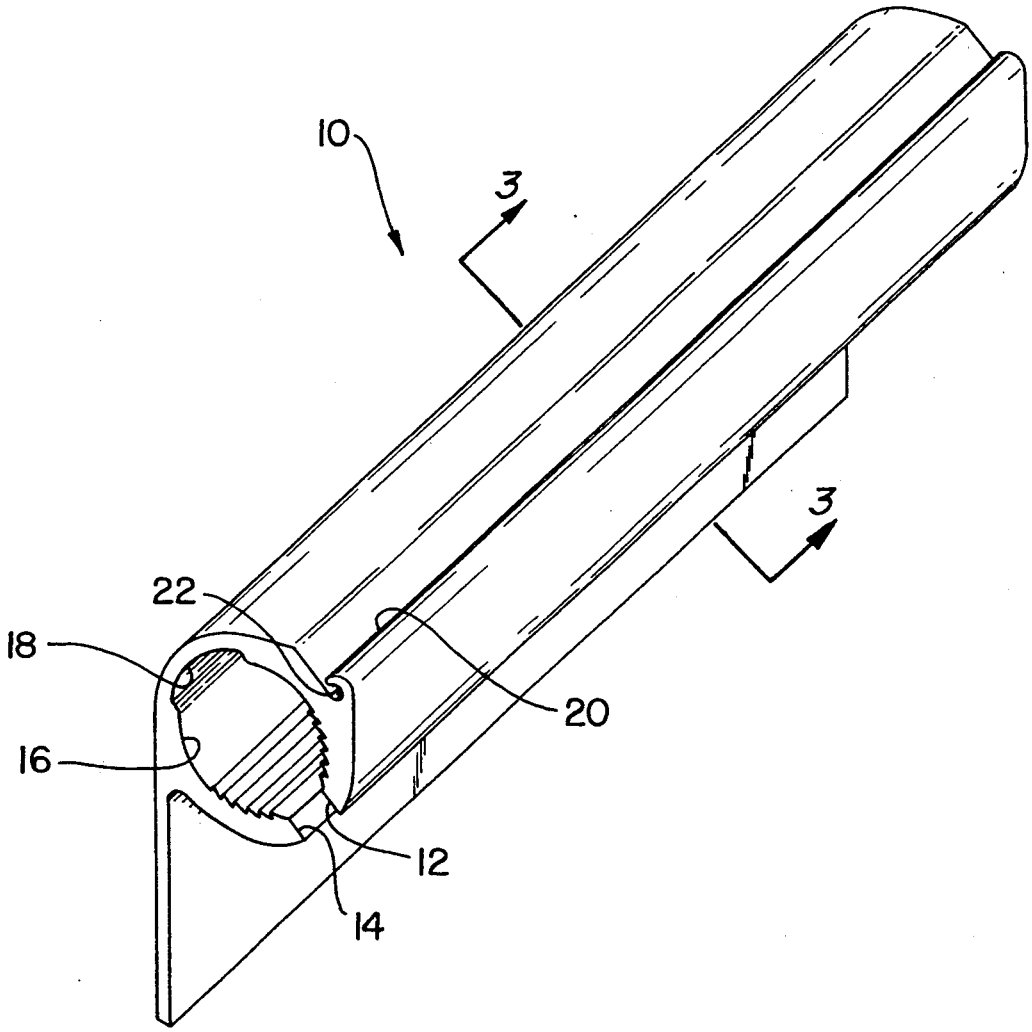
FIG. 2 is a perspective view of a clamp of the present invention.
Figure 3:
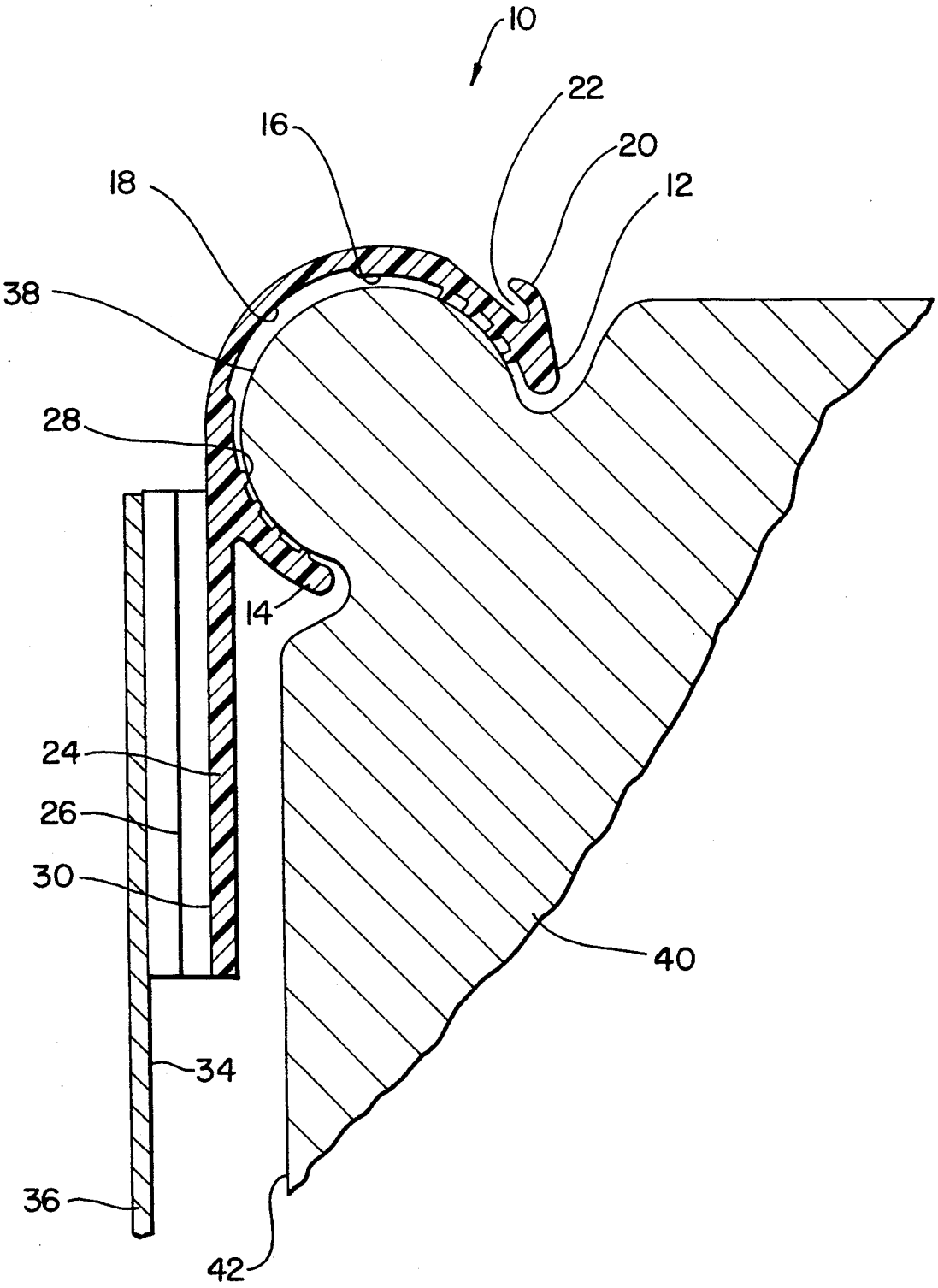
FIG. 3 is a cross-sectional view taken along line 3—3 of FIG. 2 showing the clamp of the present invention attached to a box spring with a dust ruffle attached thereto.

As shown in FIG. 2, a clamp 10 is disclosed having a first end 12 and a second end 14. The inside surface of the clamp 10 defines a clamping area 16. Midway between the first end 16 and the second end 14 along the clamp 10 is a section with reduced thickness 18. Adjacent the first end 12 is a lip 20 on the outside of the clamp defining a pry groove 22. As shown in FIG. 3, tangentially extending from the clamp 10 is an extension 24, that when assembled on a box spring 40, the extension 24 is adjacent to a vertical side 42 of the box spring 40. Attached to the extension 24 is means for fastening 26 a dust ruffle 36 to the extension 24. The clamp 10 is preferably made from a resilient type material to allow the user to easily attach the dust ruffle clamp 10 to the box spring 40 placing an object, such as a putty knife, screwdriver,-or the like (not shown), into the groove 22, applying force to separate the first end 12 from the second end 14, and sliding the first end 12 and the second end 14 over a box spring frame 38. The box spring frame 38 protrudes sufficiently enough from the typical box spring 40 to allow attachment of the clamp 10. When the object is removed from the groove 22, removing the force separating the first end 12 and the second end 14, the ends 12 and 14 conform to their original position, allowing the clamping area 16 to be in clamping contact against the box spring frame 38. The reduced thickness section 18 allows the first end 12 and the second end 14 to be easily separated when force is applied against the lip 20 by the object. The clamp may also have pry grooves at the first and the second ends of the clamp for separating the ends during assembly or disassembly to the box spring frame. The clamping area 16 may have a series of protrusions 28, which may be angled slightly to help the clamp 10 grip the box spring frame 38. The clamp 10 is applied to the box spring 40 so that the extension 24 is positioned adjacent a box spring vertical side 42.

Fastening means, such as a hook and loop fastener 26, may be applied to an outside surface 30 of extension 24 and an inside surface 34 of the dust ruffle 36. The hook and loop fastener 26 is used in this preferred embodiment, but it is not intended to limit the scope of the claims. Any fastening means, such as snaps or buttons, that would attach the dust ruffle to the extension 24 would be sufficient. A plurality of clamps 10 may be applied as needed along three outside surfaces of the top of the box spring frame 38 to provide effective fastening of the dust ruffle 36 to the periphery of box spring 40. The clamp 10 may be made of an extruded resilient polymer material allowing simple and low cost manufacturing techniques to be utilized. Spring steel may also be used to make the clamp. The clamp may be made in varying lengths to increase the length of the dust ruffle fastening means.

Although this invention has been shown and described with respect to a detailed embodiment thereof, it will be understood by those skilled in the art that various changes in form and detail thereof may be made without departing from the spirit and scope of the claimed invention.

We claim:

1. A method for attaching a dust ruffle for a bed onto a box spring having a box spring frame, the method comprising:

providing a clamp having a pry groove, a first end, a second end, and an extension;

placing an object in the groove;

applying force to the groove forcing the first end away from the second end;

placing the clamp over the box spring frame;

removing the force and the object from the groove wherein the first end and the second end retain their original shape, the clamp being in clamping contact with the box spring frame, wherein the extension is positioned adjacent to the box spring;

fastening the dust ruffle to the extension using fastening means.

2. The method of claim 1 wherein the fastening means is a hook and loop fastener.

3. The method of claim 1 wherein the clamp is made from a resilient material.

4. The method of claim 1 wherein the clamp has a first groove at the first end and a second groove at the second end for separating the ends during assembly or disassembly to the box spring frame.

5. A dust ruffle clamp for clamping a bed dust ruffle to a bed box spring having a box spring frame, the clamp comprising:

a clamp having a first end, a second end, an inside surface, and outside surface, wherein the inside surface defines a clamping area;

the outside surface having an extension and a lip defining a pry groove;

means for fastening the dust ruffle to the extension, wherein the ends are separated by the pry groove so the clamping area comes into clamping contact with the box spring frame and the extension is adjacent to the box spring.

6. The clamp of claim 5 wherein the means for fastening the dust ruffle to the extension is a hook and loop fastener system.

7. The clamp of claim 5 wherein the clamp further comprises a first groove at the first end and a second groove at the second end for separating the ends during assembly or disassembly to the box spring frame.

8. The clamp of claim 5 wherein the clamp is made from a resilient material.

9. The clamp of claim 5 wherein the clamping area further comprises a series of protrusions for gripping the box spring frame.

* * * * *